US005246413A

United States Patent [19]

Koblick

[11] Patent Number: 5,246,413

[45] Date of Patent: Sep. 21, 1993

[54] EXERCISE APPARATUS

[76] Inventor: Jeffrey M. Koblick, Minnetonka, Minn.

[21] Appl. No.: 886,692

[22] Filed: May 20, 1992

[51] Int. Cl.[5] ..... A63B 21/02

[52] U.S. Cl. ..... 482/126; 482/121

[58] Field of Search ..... 482/121, 122, 126, 907, 482/908

[56] References Cited

U.S. PATENT DOCUMENTS

| | | | |
|---|---|---|---|
| D. 322,827 | 12/1991 | Bennstrom et al. . | |
| 552,971 | 1/1886 | Sandow . | |
| 4,428,577 | 1/1984 | Weingardt . | |
| 4,492,376 | 1/1985 | Schatz et al. . | |
| 4,629,186 | 12/1986 | Aldridge | 482/126 |
| 4,702,474 | 10/1987 | Guibert | 482/126 |
| 4,763,897 | 8/1988 | Yakata | 482/908 |
| 4,830,366 | 5/1989 | Ruden . | |
| 4,856,776 | 8/1989 | Ching-Liang . | |
| 4,861,022 | 8/1989 | Boatcallie . | |
| 4,909,506 | 3/1990 | Smith . | |
| 5,022,648 | 6/1991 | Travis | 482/122 |

FOREIGN PATENT DOCUMENTS

| | | | |
|---|---|---|---|
| 0448275 | 8/1927 | Fed. Rep. of Germany | 482/126 |
| 1428827 | 11/1968 | Fed. Rep. of Germany | 482/126 |
| 0791616 | 12/1935 | France | 482/126 |
| 526253 | 9/1940 | United Kingdom | 482/122 |

OTHER PUBLICATIONS

Advertisement for THIGH THINNER brand Exercise Device.

*Primary Examiner*—Richard J. Apley
*Assistant Examiner*—Lynne A. Reichard
*Attorney, Agent, or Firm*—Allegretti & Witcoff, Ltd.

[57] ABSTRACT

A novel exercise apparatus is disclosed as having first and second levers rotatably connected by a pivot means with resilient means for providing a restorative force against which pressure is applied being coupled to the first and second levers. The novel exercise apparatus further has cover means for housing the pivot means which is adapted to allow pivoting of the first and second levers and limit means for defining a relaxed position of the exercise apparatus with the limit means being interactive with and limiting movement of the first and second levers.

21 Claims, 4 Drawing Sheets

EXERCISE APPARATUS

BACKGROUND OF THE INVENTION

Generally, conventional exercise equipment may utilize a force against which to apply pressure to exercise muscle tissue and promote muscle development. Examples of such conventional exercise equipment range from cumbersome cast iron dumbbells to elaborate and expensive exercise machines such as those found in health clubs. Existing exercise equipment, however, may differ in the arrangement which produces the force against which pressure is applied. For example, conventional cast iron dumbbells utilize the force of gravity and the mass of a cast iron weight against which pressure is applied, usually in lifting the dumbbell. Other exercise machines employ a pulley system to lift weights or the tension of a spring or elastic band against which to apply pressure. Although these existing exercise machines may be satisfactory, they are often bulky, expensive and difficult to operate. For example, exercise machines, such as those commonly found in most health clubs, are often larger than the operator and require extensive instructional guidance before the user may fully gain the benefit of operation.

The design of existing exercise equipment has tended toward state of the art in man's struggle to improve muscle tone and achieve fitness. State of the art, however, does not necessarily mean bigger and more expensive. Advances have been made in exercise equipment design which allow many to exercise muscle tissue without resorting to the bulky and expensive existing machines. For example, Boatcallie U.S. Pat. No. 4,861,022 describes a muscle exerciser employing elastic bands particularly adapted to exercising chest muscles through the use of forearm force. Boatcallie, however, may be difficult to adapt to other muscle groups due to its design limitations aimed at forearm usage. U.S. Design Pat. No. Des. 322,827 discloses an exerciser which employs a coil to provide resistance against which the operator applies pressure. An exerciser commercially available under the trademark "THIGHTHINNER" employs a similar coil. Both exercisers operate on a principle similar to commercially available hand strengtheners where the operator's hand grasps two extensions of a coil and squeezes them toward one another. The exerciser is essentially a larger version of the hand strengthener utilized to exercise various muscle groups. The coil, however, may be subject to damage through improper use, such as forcing the extensions away from one another, either intentionally or by accident, rather than toward one another as in normal use. Such improper use may distort the positioning of the extensions, as well as, effect the resistance provided by the coil. Similar disadvantages may result by twisting of the coil itself during normal use.

The above examples illustrate the lack of an exercise device which can be conveniently used to exercise a variety of muscle groups and which is also designed to reduce damage to the exercise device by overuse, overextension or twisting. A need therefore exists for an exercise device which reduces the drawbacks associated with existing exercise devices and which provides advantages not found in such exercise devices.

SUMMARY OF THE INVENTION

The present invention includes a novel exercise apparatus which is easily operated. The exercise apparatus is compact and lightweight and may be employed to exercise a variety of muscle groups. The exercise apparatus has a first lever having a first anchor end, a first intermediate pivot portion and a first handle end. Further, the exercise apparatus has a second lever having a second anchor end, a second intermediate pivot portion and a second handle end. The first and second levers are joined together by pivot means for rotatably connecting the first and second intermediate pivot portions of the first and second levers. First and second resilient means for providing a restorative force against which pressure is applied are coupled to the first and second levers. The exercise apparatus further has a cover means for housing a portion of the exercise apparatus, for example, the first and second anchor ends, the pivot means, and the first and second resilient means with the cover means being adapted to allow for the pivoting of the first and second levers. The exercise apparatus also has limit means for defining a "relaxed" state of the exercise apparatus prior to use.

It is accordingly an object of the present invention to provide an exercise apparatus which may be employed to exercise a variety of muscle groups. It is a further object of the present invention to provide an exercise apparatus that is easy to operate. It is a still further object to provide a compact, durable, lightweight and economical exercise apparatus. Other objects, features or advantages of the present invention will become apparent from the following description taken in conjunction with the accompanying drawings.

BRIEF DESCRIPTION OF THE DRAWINGS

In the course of the detailed description of preferred embodiments to follow, reference will be made to the attached drawings, in which.

DESCRIPTION OF PREFERRED EMBODIMENTS

The principles of the present invention may be applied with particular advantage to provide a novel exercise apparatus, a preferred embodiment of which may be generally seen in FIGS. 1, 2 and 3 and which is described more fully below.

Figure 1:
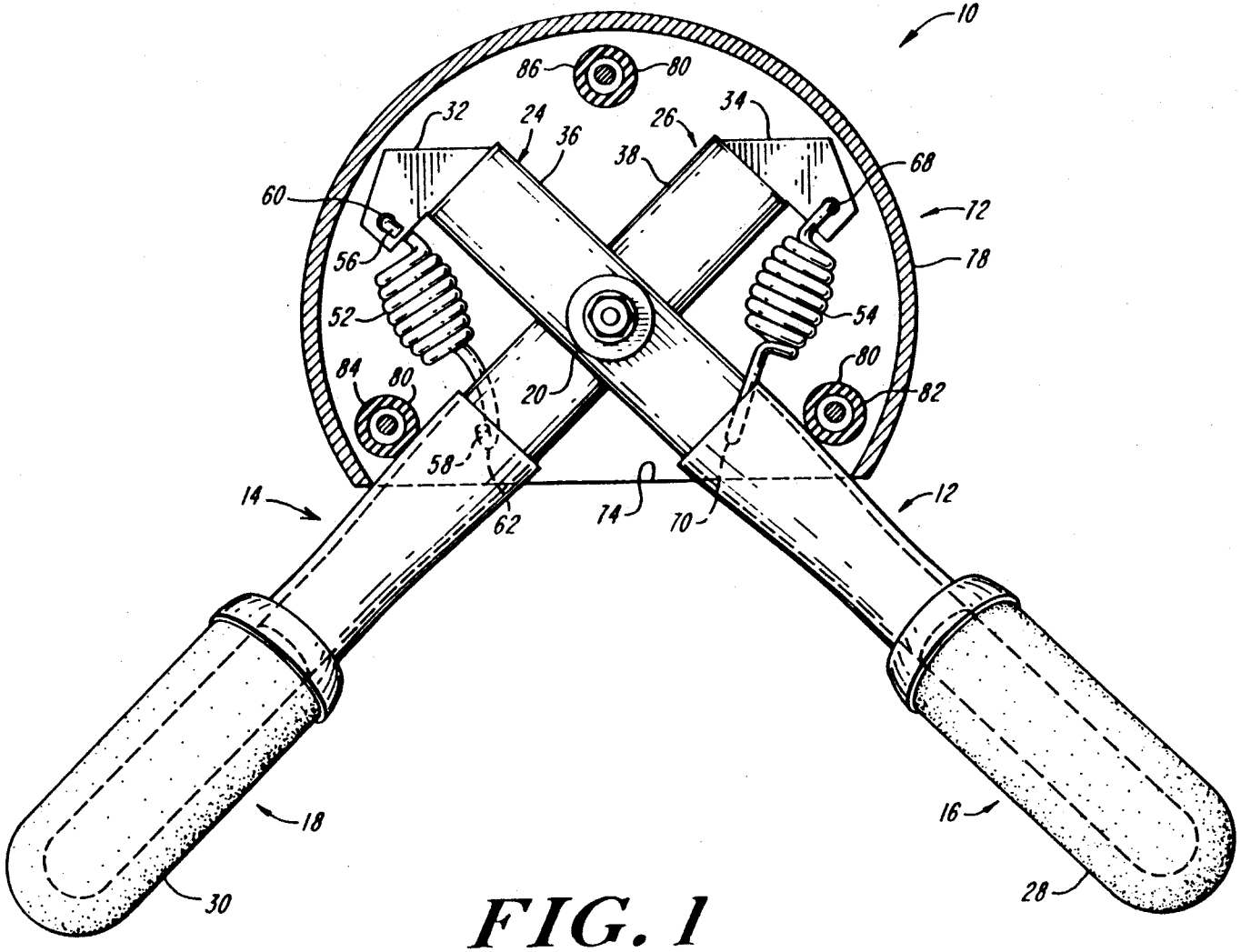
FIG. 1 is a front view of an exercise apparatus in accordance with an embodiment of the present invention, with a section of cover means removed and with the exercise apparatus being in a relaxed position.
Figure 2:
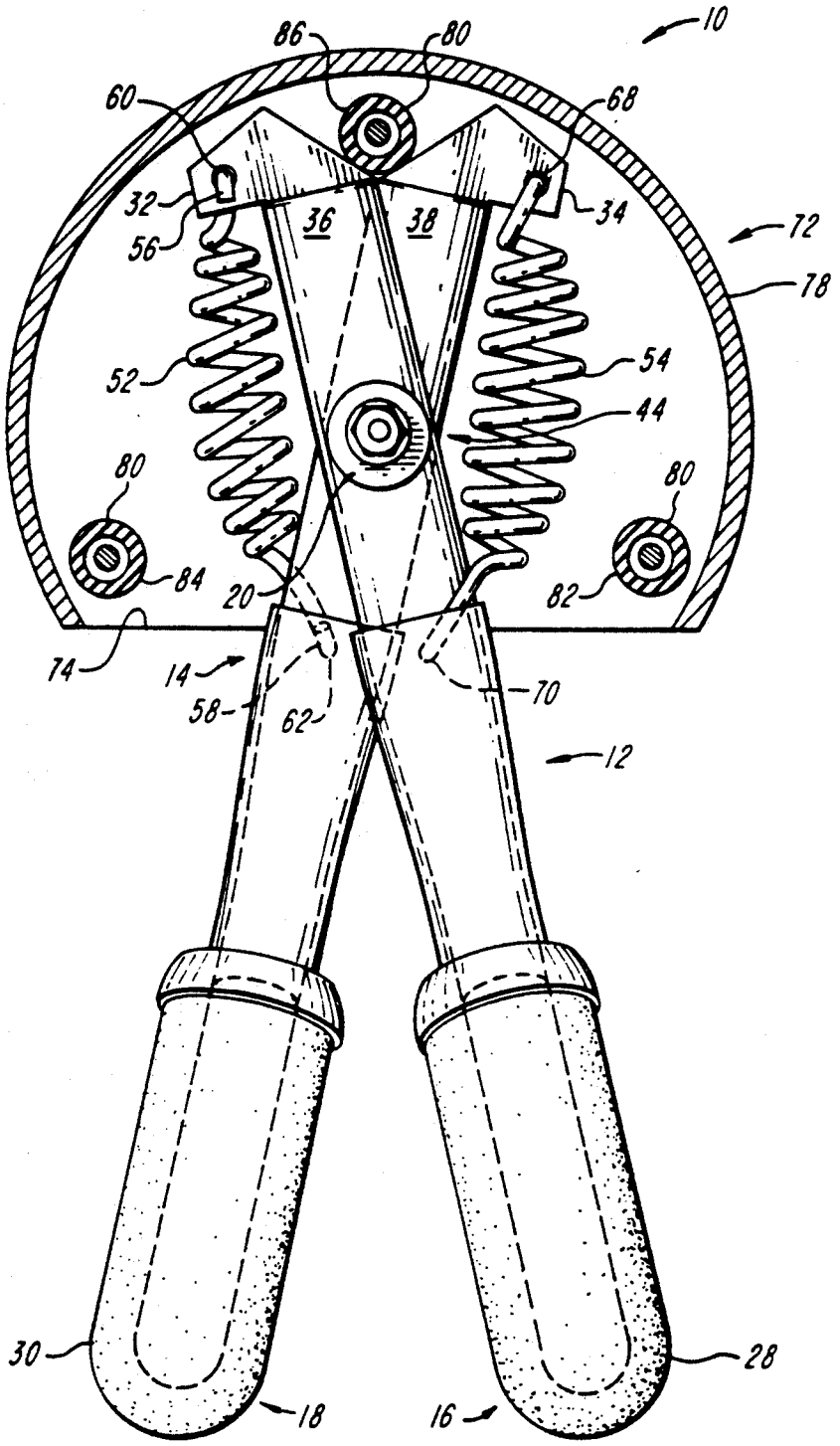
FIG. 2 is a front view of the exercise apparatus of FIG. 1, with the exercise apparatus being in a fully flexed position.
Figure 3:
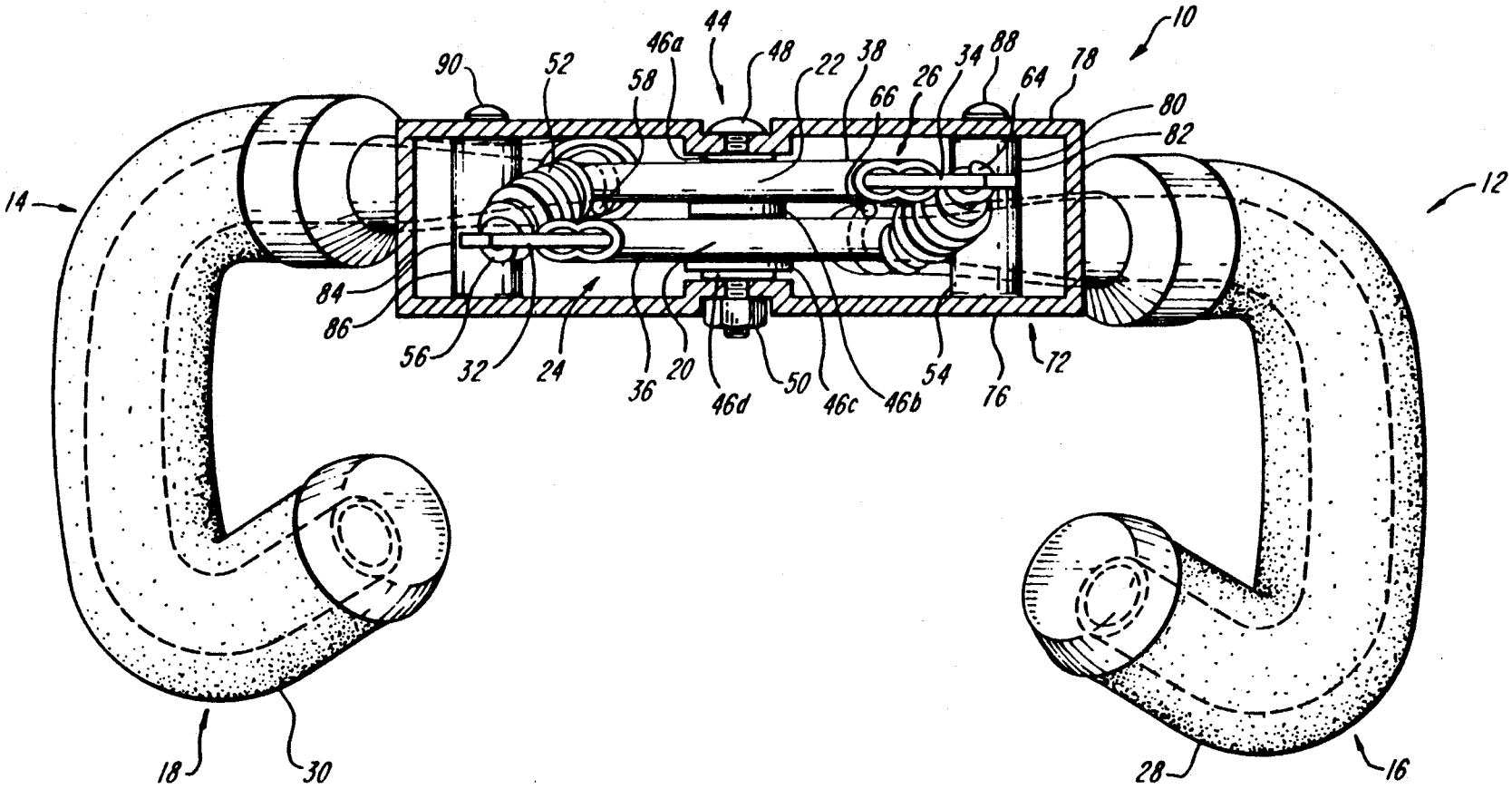
FIG. 3 is a top view of the exercise apparatus of FIG. 1, with cover means in cross-section.

Referring to FIGS. 1, 2 and 3, exercise apparatus 10 has first and second levers seen generally at 12 and 14 respectively. First and second levers 12 and 14 may be composed of any suitable rigid material, but are preferably composed of a durable metal such as steel. First and second levers 12 and 14 each have first and second handle ends seen generally at 16 and 18, first and second intermediate pivot portions 20 and 22, and first and second anchor ends seen generally at 24 and 26. First and second levers 12 and 14 are also preferably unitary and tubular, i.e. hollow, to decrease the weight of exercise apparatus 10.

First and second handle ends 16 and 18 are cylindrical and substantially U-shaped to facilitate their gripping, for example, by hands or their placement between legs or arms during operation of exercise apparatus 10. First and second handle ends 16 and 18 may be covered by any suitable cushioning material such as foam rubber, as indicated at 28 and 30 in FIGS. 1, 2 and 3, to facilitate comfort during operation.

First and second anchor ends 24 and 26 have first and second anchor extensions 32 and 34 extending from first and second terminal ends 36 and 38 of first and second levers 12 and 14, respectively. First and second anchor extensions 32 and 34 may be integral with first and second terminal ends 36 and 38 or more preferably are rigidly fixed to first and second terminal ends 36 and 38, respectively. As can be seen in FIG. 3, first and second terminal ends 36 and 38 of levers 12 and 14 are substantially oblong and tubular. First and second anchor extensions 32 and 34 extend within first and second levers 12 and 14 respectively. In a preferred embodiment, first and second anchor extensions 32 and 34 are substantially L-shaped extension plates secured to first and second levers 12 and 14, respectively.

As illustrated in FIGS. 1, 2, and 3, first anchor extension 32 extends outwardly and approximately perpendicular from first terminal end 36 and away from second terminal end 38 toward second handle end 18 of second lever 14. Likewise, second anchor extension 34 extends outwardly and approximately perpendicular from second terminal end 38 and away from first terminal end 36 toward first handle end 16 of first lever 12.

Figure 4:
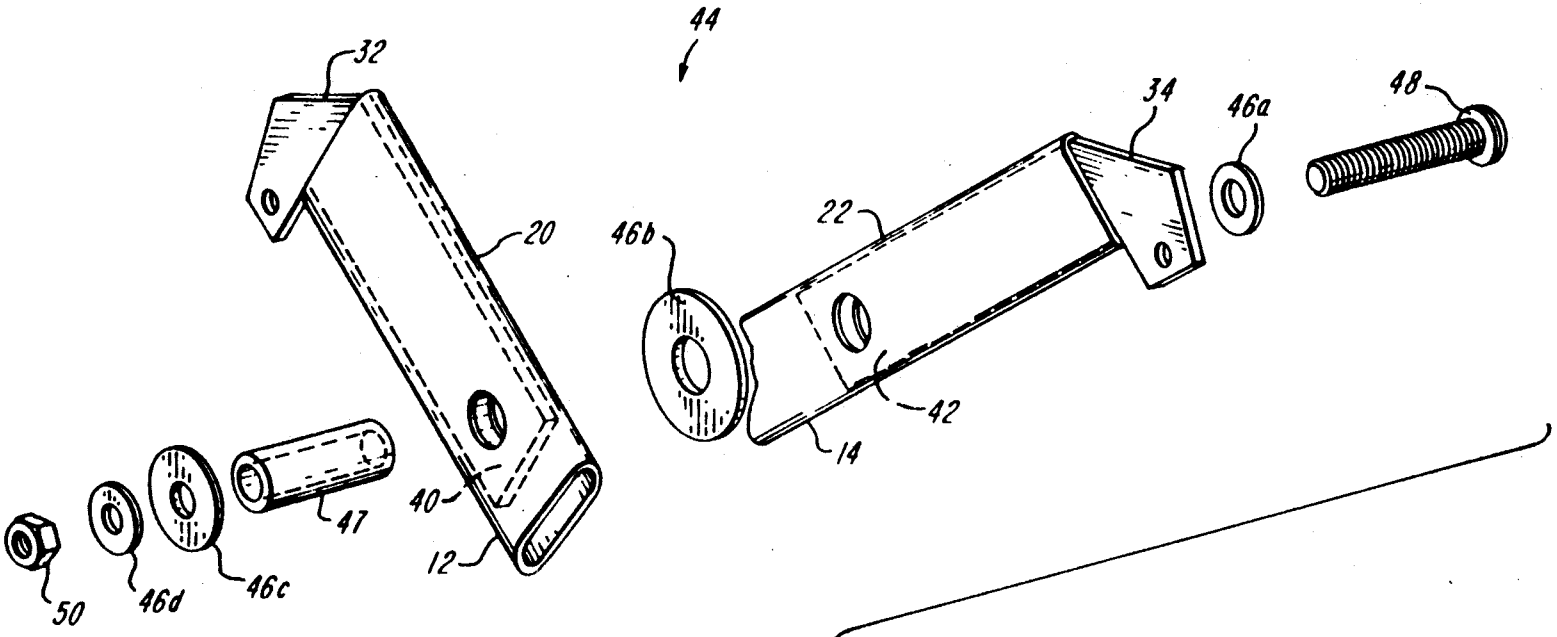
FIG. 4 is an exploded view of a portion of the exercise apparatus of FIG. 1 showing a mechanism for pivotally connecting two levers which are to be spring biased.

Exercise apparatus 10 has pivot means 44, details of which are illustrated by the exploded view of FIG. 4, for rotatably connecting first lever 12 with second lever 14 and for securing first and second anchor extensions 32 and 34 within first and second levers 12 and 14, respectively. Pivot means 44 is comprised of a series of circular washers 46(*a*), 46(*b*), 46(*c*), and 46(*d*) which sandwich first and second levers 12 and 14 with the openings of the washers coinciding with openings in levers 12 and 14 at first and second intermediate pivot portions 20 and 22. Washer 46(*b*) is positioned between first lever 12 and second lever 14 to provide a separation distance between the levers thereby reducing wear due to friction during use of apparatus 10. First and second anchor extensions 32 and 34, have arms 40 and 42, respectively, which extend within levers 12 and 14, respectively, beyond first and second intermediate pivot portions 20 and 22 as shown in FIG. 4. Arms 40 and 42 each have openings which coincide with the openings of first and second intermediate pivot portions 20 and 22. As can be further seen in FIG. 4, pivot means 44 secures first and second anchor extensions 32 and 34 within first and second levers 12 and 14, respectively. Pivot means 44 has cylindrical bushing 47 which extends through first and second intermediate pivot portions 20 and 22, arms 40 and 42 and washer 46 (*b*) at their respective openings thereby facilitating the securing of first and second anchor extensions 32 and 34 within first and second levers 12 and 14, respectively. Cylindrical bushing 47, preferably, is flush with the outside edges of first and second intermediate pivot portions 20 and 22. Bolt 48 extends through cylindrical bushing 47 and washers 46(*a*), 46(*b*), 46(*c*), and 46(*d*) and is then secured by nut 50, thereby creating an axis of rotation about which each lever may rotate. As can be seen more clearly in FIG. 3, first and second anchor ends 24 and 26 and first and second intermediate pivot portions 20 and 22 are substantially oblong to decrease the width of exercise apparatus 10 when viewed from the head section of bolt 48 to nut 50. In a preferred embodiment, first and second anchor extensions 32 and 34 and cylindrical bushing 47 are formed from steel and heat treated to result in substantially the same hardness to minimize wear due to friction during operation of exercise apparatus 10. First and second anchor extensions 32 and 34 and cylindrical bushing 47 are preferably heat treated to a hardness value of 40–42 on the Rockwell scale C.

It is to be understood that pivot means 44 may be used for applications other than exercise apparatus 10. Pivot means 44 is a mechanism for pivotally connecting two levers which are spring biased. Applications for pivot means 44 include spring biased utility tools such as clippers or scissors and the like as well as spring biased door hinges. Pivot means 44 is adapted to reduce frictional wear to first and second levers 12 and 14 which may result during pivoting motion. Arms 40 and 42 interact with cylindrical bushing 47 to minimize such frictional wear. Additionally, as previously described, cylindrical bushing 47 and arms 40 and 42 are heated to substantially the same hardness to reduce any frictional wear which may result from their interaction.

As illustrated in FIGS. 1, 2, and 3, exercise apparatus 10 has first and second resilient means 52 and 54 for providing a restorative force against which the operator exerts pressure. As illustrated in FIG. 1 and FIG. 2, first and second resilient means 52 and 54 are first and second coiled springs which, during operation of exercise apparatus 10, may be elongated. However, first and second resilient means 52 and 54 may be any suitable resilient means coupled to first and second levers 12 and 14.

As illustrated in FIGS. 1, 2, and 3, first resilient means 52 has hooks 56 and 58 which engage and extend through first anchor extension 32 via opening 60 and engage and extend through second handle end 18 via opening 62, respectively. As previously indicated, levers 12 and 14 are tubular, accordingly hook 58 is supported by two surfaces at second handle end 18 thereby minimizing wear due to friction during operation of exercise apparatus 10. The restorative force of first resilient means 52 tends to draw first anchor end 24 and second handle end 18 toward one another. Similarly, second resilient means 54 has hooks 64 and 66 as seen in FIG. 3 which engage and extend through second anchor extension 34 via opening 68 and engage and extend through first handle end 16 via opening 70, respectively. Similar to hook 58, hook 64 is supported by two surfaces at first handle end 16 thereby minimizing wear during operation of exercise apparatus 10. The restorative force of second resilient means 54 tends to draw second anchor end 26 and first handle end 16 toward one another. First and second resilient means 52 and 54 operate to bias first and second handle ends 16 and 18 away from each other toward a relaxed position. As can be seen in FIGS. 1 and 2, hooks 58 and 66 are covered by a rubber coating which acts as a damper to prevent noise created by movement of the hook within its opening during operation of apparatus 10. In a preferred embodiment, first and second resilient means 52 and 54, are formed from steel and are heat treated to result in substantially the same hardness as first and second anchor extensions 32 and 34 to minimize wear due to friction during operation of exercise apparatus 10.

FIGS. 1, 2 and 3 illustrate cover means, seen generally at 72, which is essentially a semicircular housing having opening 74 formed from two approximately semicircular sections 76 and 78 which are secured together for housing first and second anchor ends 24 and 26, pivot means 44, and first and second resilient means 52 and 54. FIGS. 1 and 2 illustrate section 78 of cover means 72 with section 76 removed to reveal the housed portion of exercise apparatus 10. FIG. 3 shows a top view of exercise apparatus 10 with cover means 72 in cross-section. Opening 74 allows the pivoting of first and second levers 12 and 14 which extend through opening 74. Sections 76 and 78 of cover means 72 are fitted together and secured to first and second levers 12 and 14 by bolt 48 and nut 50 of pivot means 44 as indicated in FIG. 3. Cover means 72 may be formed from plastic or other suitable lightweight material and may be either transparent thereby allowing the operator to see the relative movement of the levers and the resilient means or opaque if this viewing is not desired.

In a preferred embodiment, exercise apparatus 10 further includes limit means, generally indicated at 80, for defining relaxed and fully flexed positions of exercise apparatus 10. Limit means 80 are interactive with and limit movement of first and second levers 12 and 14. The relaxed and fully flexed positions are shown in FIGS. 1 and 2, respectively. As can be seen in FIG. 3, and in cross-section in FIGS. 1 and 2, limit means 80 includes first and second stops 82 and 84 within cover means 72. First and second stops 82 and 84 are oppositely adjacent opening 74 and define the relaxed position by engaging first and second handle ends 16 and 18, respectively, of first and second levers 12 and 14, respectively. First and second stops 82 and 84 are covered with a cushioning material to cushion contact and substantially reduce engagement noise during operation of exercise apparatus 10. The relaxed position is preferably characterized by first and second levers 12 and 14 being held firmly against first and second stops 82 and 84, respectively, by first and second resilient means 52 and 54 such that first and second levers 12 and 14 remain stationary when not in use. It is to be understood that in the absence of first and second stops 82 and 84, first and second levers 12 and 14 rest against cover means 72 thereby defining a relaxed position.

Limit means 80 further includes third cushioned stop 86 which defines the fully flexed position of exercise apparatus 10. Third stop 86 is positioned within cover means 72, substantially equidistant from first and second stops 82 and 84, opposite pivot means 44, and substantially equidistant from first and second terminal ends 36 and 38. First and second anchor ends 24 and 26 engage third stop 86 as first and second handle ends 16 and 18 are forced toward one another against the restorative force of resilient means 52 and 54. Exercise apparatus 10 is fully flexed when first and second handle ends 16 and 18 can no longer be forced together. Third stop 86 preferably prevents first and second handle ends 16 and 18 from contacting each other so that one may operate exercise apparatus 10 by hand without the worry of one's hands striking together during operation.

First, second and third stops 82, 84, and 86, are preferably cylindrical and integral with sections 76 and 78 of cover means 72 and are adapted to receive a machine screw as indicated at 88 and 90 in FIG. 3 thereby facilitating assembly of exercise device 10.

In the practice of the present invention and as illustrated by FIG. 1, first and second resilient means 52 and 54 force first and second levers 12 and 14 firmly against first and second stops 82 and 84 thereby defining a relaxed position such that levers 12 and 14 are stationary prior to use. The operator then forces first and second handle ends 16 and 18 toward one another against the restorative force of first and second resilient means 52 and 54 toward a fully flexed position which is illustrated in FIG. 2. Specifically, U-shaped first and second handle ends 16 and 18 may be either grasped by the operator's hands or placed between the operator's arms or thighs. The operator then applies pressure from these muscle groups to force first and second handle ends 16 and 18 toward one another against the restorative force of first and second resilient means 52 and 54 until first and second anchor ends 24 and 26 contact third stop 86 as seen in FIG. 2 thereby preventing further movement of first and second handle ends 16 and 18 toward one another and thereby defining a fully flexed position. Referring to FIGS. 1 and 2, first and second resilient means 52 and 54 of FIG. 2 are elongated relative to first and second resilient means 52 and 54 of FIG. 1. The operator then relaxes the muscle group allowing the restorative force of first and second resilient means 52 and 54 to bring exercise apparatus 10 back to a relaxed position as indicated in FIG. 1. The process is then repeated as often as desired to achieve a particular level of muscle fitness. It should be understood that although the above description of use details operation of exercise apparatus 10 between extreme positions of being relaxed and fully flexed as indicated in Figs. 1 and 2, exercise apparatus 10 may be operated to any position between relaxed and fully flexed as desired by the particular operator.

It is to be understood that the embodiments of the invention which have been described are merely illustrative of some applications of the principles of the invention. Modifications may be made by those skilled in the art without departing from the true spirit and scope of the invention.

What is claimed is:

1. An exercise apparatus comprising:

a first lever having a first handle end, a first intermediate pivot portion and a first anchor end;

a second lever having a second handle end, a second intermediate pivot portion and a second anchor end;

pivot means for rotatable connecting said first and second intermediate pivot portions of said first and second levers;

resilient means for providing a restorative force against which pressure is applied, said resilient means being coupled to said first and second anchor ends;

cover means for housing said first and second anchor ends, said pivot means and said resilient means, said cover means being adapted to allow pivoting of said first and second levers and said cover means being interactive with and limiting movement of said first and second levers to define a relaxed position of said exercise apparatus said first and second anchor ends including first and second anchor extensions extending from first and second terminal ends, respectively, of said first and second levers, each of said first and second anchor extensions having an arm, said arm of said first anchor extension extending into said first lever and said arm of said second anchor extension extending into said second lever, said arms of said first and second anchor extensions having openings which are engaged by said pivot means to secure said first and second anchor extensions to said first and second levers, respectively.

2. The exercise apparatus as set forth in claim 1 wherein said first and second anchor extensions are substantially L-shaped extension plates secured to said first and second levers, respectively.

3. The exercise apparatus as set forth in claim 2 wherein said pivot means comprises a cylindrical bushing extending through said openings of said arms of said first and second anchor extensions and openings in said first and second levers thereby securing said first and second anchor extensions to said first and second levers.

4. The exercise apparatus as set forth in claim 3 wherein said pivot means further comprises, a series of circular washers which sandwich said first and second levers with one of said washers positioned between said first and second levers, openings of said washers coinciding with said openings in said first and second levers, and a bolt extending through said cylindrical bushing and said washers which is then secured by a nut thereby creating an axis of rotation about which each lever may rotate.

5. The exercise apparatus as set forth in claim 4 wherein said resilient means include first and second springs, said first spring interconnecting said first anchor end with said second handle end and said second spring interconnecting said second anchor end with said first handle end.

6. The exercise apparatus as set forth in claim 5 wherein said cover means includes a semicircular housing formed from two approximately semicircular sections secured together, said cover mans having an opening.

7. The exercise apparatus as set forth in claim 6 further comprising limit means for further defining said relaxed position of said exercise apparatus, said limit means being interactive with and limiting movement of said first and second levers.

8. The exercise apparatus as set forth in claim 7 wherein said limit means include first and second stops within said cover means.

9. The exercise apparatus as set forth in claim 8 wherein said first and second stops are positioned oppositely adjacent said opening of said cover means and engage said first and second levers.

10. The exercise apparatus as set forth in claim 9 wherein said first and second stops are cylindrical and covered with a cushioning material.

11. The exercise apparatus as set forth in claim 10 wherein said limit means further define a fully flexed position, said limit means including a third stop positioned within said cover means, substantially equidistant from said first and second stops, opposite said pivot means and substantially equidistant from said first and second terminal ends.

12. The exercise apparatus as set forth in claim 11 wherein said first and second handle ends are substantially U-shaped.

13. An exercise apparatus comprising, a first lever having a substantially U-shaped first handle end, a first intermediate pivot portion and a first anchor end;

a second lever having a substantially U-shaped second handle end, a second intermediate pivot portion and a second anchor end;

said first and second anchor ends including first and second anchor extensions extending from first and second oblong terminal ends, respectively of said first and second levers;

pivot means for rotatably connecting said first and second intermediate pivot portions of said first and second levers;

first and second springs, said first spring interconnecting said first anchor end with said second handle end and said second spring interconnecting said second anchor end with said first handle end;

cover means for housing said first and second anchor ends, said pivot means and said first and second springs, said cover means including a semicircular housing formed from two approximately semicircular sections secured together, said cover means having an openings adapted to allow pivoting of said first and second levers, said cover means being interactive with and limiting movement of said first and second levers to define a relaxed position of said exercise apparatus, and limit means for further defining a relaxed position of said exercise apparatus, said limit means being first and second stops positioned oppositely adjacent said opening of said cover means and engaging said first and second levers.

14. The exercise apparatus as set forth in claim 13 wherein each of said first and second anchor extensions having an arm, said arm of said first anchor extension extending into said first lever and said arm of said second anchor extension extending into said second lever.

15. The exercise apparatus as set forth in claim 14 wherein said arms of said first and second anchor extensions have openings which are engaged by said pivot means to secure said first and second anchor extensions to said first and second levers, respectively.

16. The exercise apparatus as set forth in claim 15 wherein said pivot means comprises a cylindrical bushing extending through said openings of said arms of said first and second anchor extensions and openings in said first and second levers thereby securing said first and second anchor extensions to said first and second levers, respectively.

17. The exercise apparatus as set forth in claim 16 wherein said pivot means further comprises, a series of circular washers which sandwich said first and second levers with one of said washers positioned between said first and second levers, openings of said washers coinciding with said openings in said first and second levers, and a bolt extending through said cylindrical bushing and said washers which is then secured by a nut thereby creating an axis of rotation about which each lever may rotate.

18. An exercise apparatus comprising:

a first lever having a substantially U-shaped first handle end, a first intermediate pivot portion and a first anchor end;

a second lever having a substantially U-shaped second handle end, a second intermediate pivot portion and a second anchor end;

said first and second anchor ends including first and second anchor extensions extending from first and second oblong terminal ends, respectively of said first and second levers, each of said first and second anchor extensions having an arm, said arm of said first anchor extension extending into said first lever and said arm of said second anchor extension extending into said second lever;

pivot means for rotatably connecting said first and second intermediate pivot portions of said first and second levers, said pivot means comprising a series of circular washers which sandwich said first and second levers with one of said washers positioned between said first and second levers, openings of said washers coinciding with openings in said first and second intermediate pivot portions and said arms of said first and second anchor extensions, a cylindrical bushing extending through said openings of said first and second intermediate pivot portions, said openings of said arms, and said opening of said washer positioned between said first and second levers, with a bolt extending through said cylindrical bushing and said washers which is then secured by a nut thereby creating an axis of rotation about which each lever may rotate, said pivot means thereby securing said first and second anchor extensions to said first and second levers, respectively;

first and second springs, said first spring interconnecting said first anchor end with said second handle end and said second spring interconnecting said second anchor end with said first handle end;

cover means for housing said first and second anchor ends, said pivot means and said first and second springs, said cover means including a semicircular housing formed from two approximately semicircular sections secured together, said cover means having an opening to allow pivoting of said first and second levers and limit means for defining a relaxed position of said exercise apparatus, said limit means being first and second cylindrical cushioned stops positioned oppositely adjacent said opening of said cover means and engaging said first and second levers, said limit means further defining a fully flexed position, said limit means including a third cushioned cylindrical stop positioned within said cover means substantially equidistant from said first and second stops, opposite said pivot means and substantially equidistant from said first and second terminal ends.

19. A mechanism for rotatably connecting two levers comprising a first lever and a second lever, pivot means for rotatably connecting said first and second levers, first and second anchor extensions extending from first and second terminal ends, respectively, of said first and second levers, each of said first and second anchor extensions having an arm, said arm of said first anchor extension extending into said first lever and said arm of said second anchor extension extending into said second lever, said arms of said first and second anchor extensions having openings which are engaged by said pivot means to secure said first and second anchor extensions to said first and second levers.

20. The mechanism as set forth in claim 19 wherein said pivot means comprises a cylindrical bushing extending through said openings of said arms and openings in said first and second levers to secure said first and second anchor extensions to said first and second levers.

21. The mechanism as set forth in claim 20 wherein said pivot means further comprises, a series of circular washers which sandwich said first and second levers with one of said washers positioned between said first and second levers, openings of said washers coinciding with said openings in said first and second levers, and a bolt extending through said cylindrical bushing and said washers which is then secured by a nut.

* * * * *